United States Patent [19]

Kanai

[11] 4,284,090

[45] Aug. 18, 1981

[54] COMBING CYLINDER OF COMBER

[76] Inventor: Hiroyuki Kanai, 15-go, 3-ban, Matsunouchi-Cho, Ashiya City, Hyogo Prefecture, Japan

[21] Appl. No.: 90,307

[22] Filed: Nov. 1, 1979

[30] Foreign Application Priority Data

| | | | |
|---|---|---|---|
| Nov. 6, 1978 | [JP] | Japan | 53-137053 |
| Jun. 11, 1979 | [JP] | Japan | 54-73798 |
| Jun. 11, 1979 | [JP] | Japan | 54-73799 |

[51] Int. Cl.[3] ..... A45D 2/50

[52] U.S. Cl. ..... 132/11 R

[58] Field of Search ..... 132/11 R, 152–154

[56] References Cited

U.S. PATENT DOCUMENTS

| | | | |
|---|---|---|---|
| 1,305,226 | 5/1919 | Kunkler | 132/11 R |
| 1,311,330 | 7/1919 | Dunner | 132/152 X |
| 3,665,937 | 5/1972 | Nakagawa | 132/11 R |

*Primary Examiner*—G. E. McNeill

*Attorney, Agent, or Firm*—Wenderoth, Lind & Ponack

[57] ABSTRACT

A combing cylinder assembly of a comber includes a needle plates laminated member and a combing cylinder proper. The needle plates laminated member is formed by laminating a plurality of needle plates, each needle plate consisting of a needle base part with a needle head at the upper portion thereof and a needle inserting part, the two parts together forming a substantially acute angle < shape with a concave recessed portion at the corner therebetween, and by inserting and locking a connecting member in the concave recessed portions. The combing cylinder proper has formed therein grooves arranged in rows, in which grooves the needle plates has grooves in rows made therein in which the needle plates laminated members are inserted.

10 Claims, 12 Drawing Figures

COMBING CYLINDER OF COMBER

BACKGROUND AND SUMMARY OF THE INVENTION

This invention relates to the construction of a combing cylinder assembly attached to a comber.

As shown by FIG. 1, the conventional combing cylinder comprises a needle plates laminated member 5 which is formed by laminating a plurality of needle plates 3, each having a needle head 1 and a dovetail groove 2 at the back of its fixing or attachment part, and by inserting a sash-like metal sheet 4 in the dovetail grooves, thus fastening the plates together, and a combing cylinder proper 6 having grooves 7 made therein in the radial direction of the cylinder (perpendicularly to the tangential plane), into each of which grooves a respective needle plates laminated member 5 is inserted.

The extent of interlocking of the groove 7 made in the combing cylinder proper 6 and the needle plates laminated member 5 is very important. In the conventional combing cylinder, when fiber is subjected to combing action by needle heads 1, the component force $F_2$ in the radial direction of cylinder works in such a direction that it tends to pull out the needle plates laminated member because the needle head is inclined toward the rotational direction of the cylinder. Thus, with long use of the combing cylinder, the gap between the needle plates laminated member 5 and the groove 7 becomes larger. Moreover, as the needle plates laminated member 5 is formed by thrusting the sash-like metal sheet 4 through dovetail grooves 2 of needle plates 3 and fastening thereto, in the case where some of the needle plates become damaged, it is necessary for taking out only the damaged needle plates to pull the needle plates laminated member 5 out of the groove 7 of the combing cylinder and cut off the sash-like metal sheet 4 by means of a chisel, pincers or the like. However, it is very difficult to cut off the sash-like metal sheet 4 without damaging good needle plates, and therefore it is inevitable that some of the good needle plates are removed to cut off the sash-like metal sheet.

In the conventional combing cylinder of a comber, needle plates laminated members are arranged at regular intervals in the rotational direction of the cylinder and needle heads are arranged at fixed intervals in the axial direction of the cylinder. With such arrangements, it is impossible to vary the needle head density by degree, and therefore the combing action required of the combing cylinder cannot be performed fully. The present invention has been made to eliminate the above-mentioned disadvantages of the conventional combing cylinder of comber.

BRIEF DESCRIPTION OF THE DRAWINGS

The nature and advantages of the present invention will be understood more clearly from the following description of preferred embodiments and accompanying drawings, in which.

DETAILED DESCRIPTION OF THE INVENTION

Figure 1:
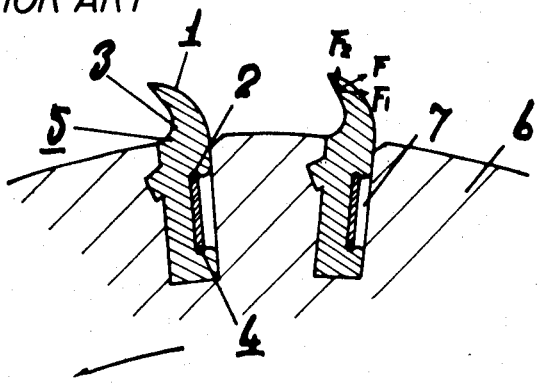
Fig. 1 PRIOR ART
FIG. 1 is a cross section of a main part of a conventional combing cylinder.
Figure 2:
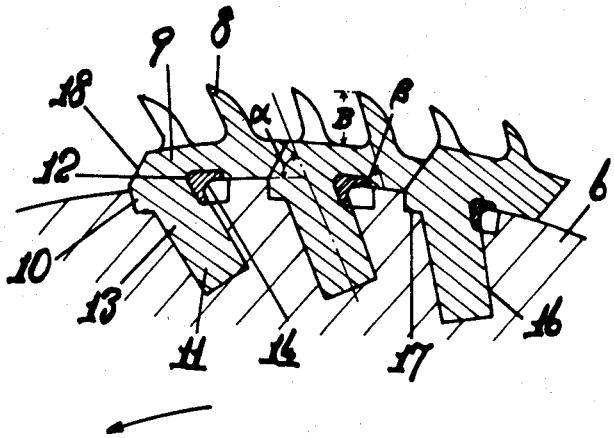
FIG. 2 is a cross section of a main part of the combing cylinder, showing an embodiment of the present invention.
Figure 3:
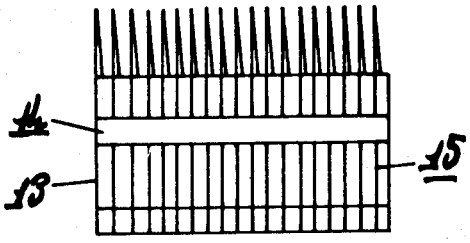
FIG. 3 is a side view of a needle plates laminated member, showing an embodiment of the present invention.
Figure 4A:
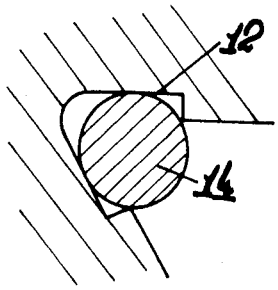
FIGS. 4(A)–4(D) are cross sections, on an enlarged scale, showing the state in which various embodiments of connecting members are inserted in a concave part formed in a corner between a needle base part and a needle inserting part of the present invention.
Figure 4B:
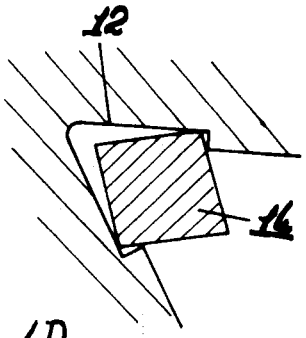
Figure 4C:
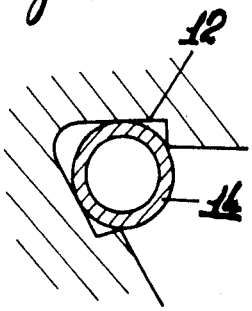
Figure 4D:
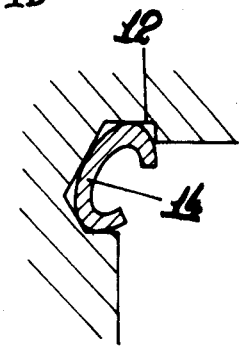

FIG. 2 is a cross section of a main part of the combing cylinder assembly for use with a comber, showing an embodiment of the present invention. FIG. 3 is a side view of a needle plates laminated member, i.e., an assembly of needle plates joined or laminated together, according to the present invention. A needle plate 13 comprises a needle base part 9 having at the upper part thereof a needle head 8 with a working angle $\beta$ in the rotational direction of the cylinder, a needle inserting part 11 having at the upper side face thereof a protrusion 10, parts 9 and 11 together forming a $<$ shape (hook-shape) as shown in FIG. 2, and a concaved recessed portion 12 at the corner between needle base part 9 and needle inserting part 11.

The above-mentioned needle plates 13 are laminated in plural layers. A bar-shaped or tubular connecting member 14 made of metal or synthetic resin is inserted in or held by the concave recessed portions 12 of the needle plates 13, as shown in FIGS. 4(A)–4(D), and by pressing and crushing the connecting member 14 into the concave recessed portions parts 12 of the needle plates 13, the concave recessed portions parts 12 are filled up and thus a needle plates laminated member 15 (i.e. a member formed by laminating together a row of needle plates) is formed. The connecting member 14 can be of such type that it is made of elastic material and is substantially C-shaped in cross section.

In the combing cylinder proper 6, grooves 16 having an inclination of the angle $\alpha$ in the rotational direction of the cylinder are made in the axial direction of the cylinder. A triangular groove 17 in which the protrusion 10 of the needle plate is fitted is made at the combing cylinder surface of the groove 16 in the axial direction of the cylinder. In each of the above-mentioned grooves 16 which are made in the combing cylinder proper 6, e.g. ten to twenty rows, a needle plates laminated member 15 is locked, and thus the combing cylinder is formed.

The depth of the needle can be varied by changing the height of the needle base part 9. Also, by arranging needle plates laminated members in such a fashion that the needle depth becomes shallow by degrees, starting from the side on which the combing cylinder first makes contact with fiber, the combing action can be improved further.

By making the end face 18 of the needle base part 9 inclined in a direction counter to the rotational direction of the cylinder and by arranging end faces 18 of the needle base parts 9 of adjoining needle plates 13 without the slightest gap therebetween, fibers are prevented from being caught by the end faces of needle base parts and from going down, with resultant improvement of the combing action.

The angle of inclination $\alpha$ of the groove 16 of the combing cylinder is 60° in this embodiment, but it is recommended that angle $\alpha$ be equal to angle $\beta$ (the working angle at the needle head) $\pm 20°$.

In the case where the difference between the angle of inclination $\alpha$ of the groove and the working angle $\beta$ at the needle head exceeds 20°, there is raised the problem that with long use of the combing cylinder, the gap between the groove and the needle plate becomes larger due to the component force which works in the direction of the groove.

Since the combing cylinder of a comber according to the present invention is constructed as mentioned above, it enables the most suitable combing action to achieve adequate fiber. The conventional combing cylinder has such disadvantage that because the grooves are formed in the radial direction, the gap between the groove and the needle plate becomes larger with extended use of the combing cylinder. On the contrary, as the combing cylinder according to the present invention has grooves which incline in the rotational direction of the cylinder, the needle plate is kept from being pulled out of the groove and a moderate interlocking of the needle plate and the groove can be maintained for many years.

The concave recessed portion provided at the corner between the needle base part and the needle inserting part is positioned nearly at the central part of the needle plate and can be utilized as a standard hole size when making needle plates by punching a metal plate. Thus, needle plates of high precision can be manufactured, and when needle plates are laminated, laminating can be done easily by using a guide bar, a connecting member or the like, which is locked in the concave recessed portion, as a guide. Also, it is possible to fix together a plurality of needle plates easily and firmly.

Moreover, when a part of a needle plates laminated member becomes damaged, the damaged needle plates can easily be removed by first making a notch in the connecting member at the part which is not in contact with the needle plates by a chisel and then by separating the needle plates manually.

In the case where a pipe is used as a connecting member, any damaged needle plate of the needle plates laminated member can be removed easily by inserting bars in the pipe from both ends and by pushing open and cutting off the needle plates laminated member through the medium of the bars.

Figure 5:
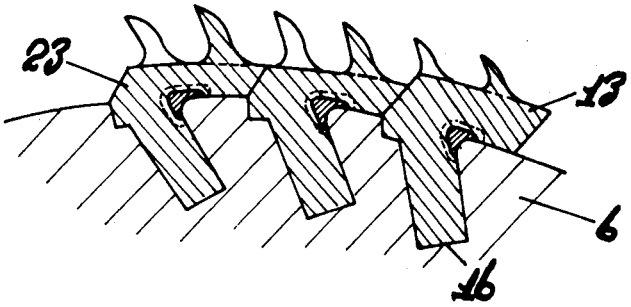
FIG. 5 is a cross section of a main part of the combing cylinder, showing another embodiment of the present invention.

FIG. 5 is a cross section of the main part of the combing cylinder of a comber, showing another embodiment of the present invention.

Figure 6:
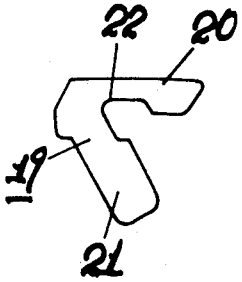
FIG. 6 is a front view of a spacer sheet to be used for the present invention.
Figure 7:
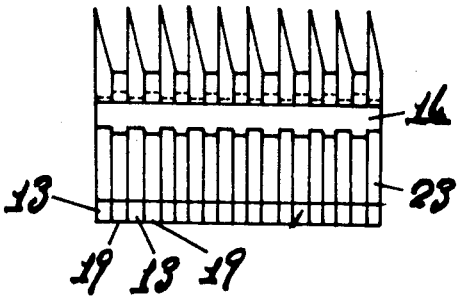
FIG. 7 is a side view of the needle plates laminated member, showing another embodiment of the present invention.

In this embodiment, a spacer sheet 19 is interposed between adjoining needle plates 13. As shown by FIG. 6, the spacer sheet 19 comprises a base part 20 and an inserting part 21, and is made of metal or synthetic resin. A concave part 22 at the corner of this spacer sheet is made a little larger than the concave recessed portion 12 of the needle plate, and thus the needle base part and the needle inserting part of spacer sheet 19 are different from those of the needle plate.

Needle plates 13 and spacer sheets 19 are laid alternately in plural layers. In the concave recessed portion 12 of the needle plate and the concave recess 22 of the spacer sheet, a bar-shaped or tubular connecting member 14 made of metal or synthetic resin is inserted and locked. By pressing and crushing the connecting member 14 into the above-mentioned concave parts, the concave parts are filled up and thus a needle plates laminated member 23 is formed.

The needle plates laminated member 23 which is constructed as mentioned above is mounted in at least one of the grooves 16, e.g. ten to twenty rows, in the combing cylinder proper 6 and thus the combing cylinder is formed.

In this embodiment, the needle plates and spacer sheets can be processed separately and therefore needle plates of high precision can be manufactured. The precision of the needle plates produces more effect at the area where the thickness of spacer sheets is large, namely, on the side where the combing cylinder first makes contact with the fiber.

As the needle plate and the spacer sheet have concave parts of different size at the respective corners, the connecting member bites into and is locked in the concave parts on different levels by pressing of the connecting member, and thus firm fastening can be obtained. Also, by varying the thickness of the spacer sheets, needle head pitch in the axial direction of the cylinder can be changed easily. In the case where spacer sheets made of synthetic resin are used for the needle plates laminated member on the side where the combing cylinder first makes contact with the fiber, even if any foreign matter is mixed in, needle plates are almost free from being damaged by such foreign matter due to the elasticity of synthetic resin.

Figure 8:
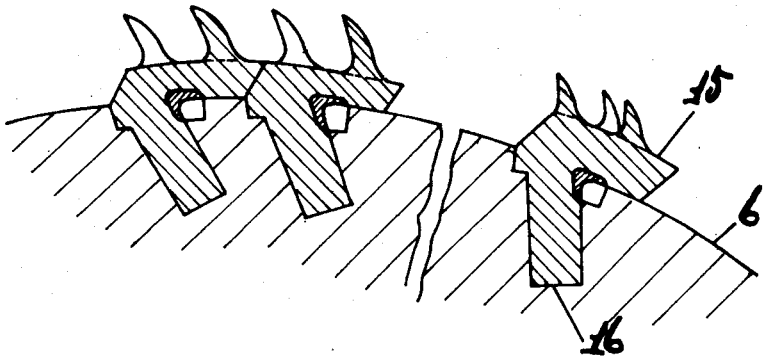
FIG. 8 is a cross section of a main part of the combing cylinder, showing still another embodiment of the present invention.
Figure 9:
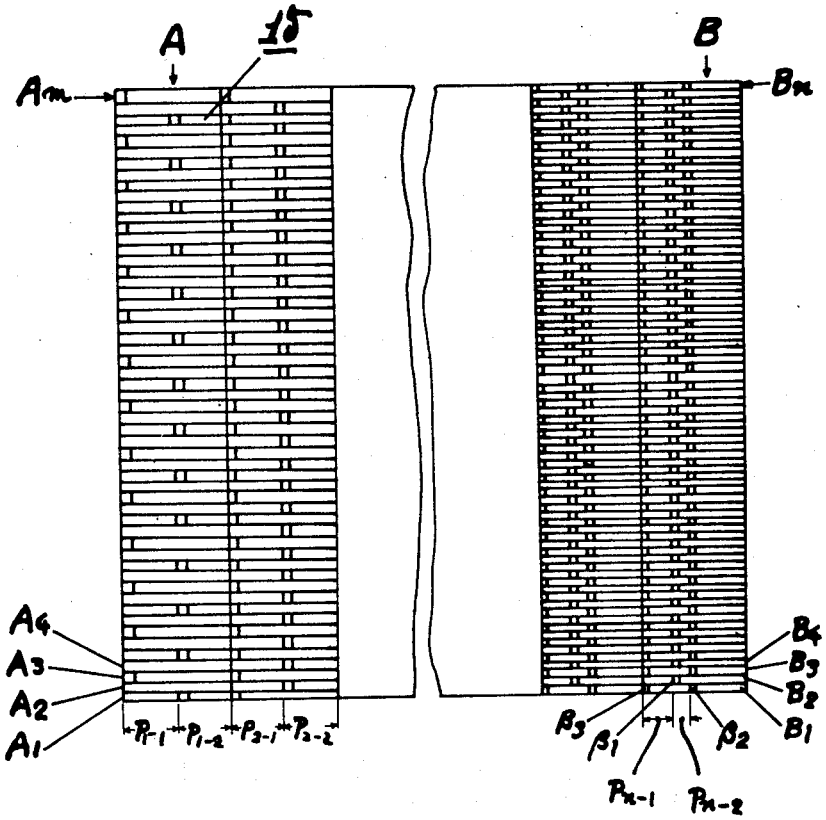
FIG. 9 is a development of the needle head.

FIG. 8 is a cross section of a main part of the combing cylinder of a comber, showing still another embodiment of the present invention. FIG. 9 is a development of the needle heads.

In this embodiment, the needle plates laminated member 15 is formed by laying needle plates, each having at least one needle head, in plural layers and by inserting and locking a connecting member in the concave parts of laminated needle plates. In the combing cylinder comprising a combing cylinder proper 6 with grooves 16 in which needle plates laminated members 15 are mounted, this embodiment provides the needle head arrangement most suitable for combing action. More particularly, at least in the first row at the front part A of the combing operation, needle heads of needle plates $A_1$, $A_3 \ldots A_m$ in the axial direction of the cylinder and the needle head pitch in the axial direction of the cylinder is widened by inserting spacer sheets $A_2$, $A_4 \ldots$ between adjoining needle plates. In the second row, needle heads are arranged in a zig-zag fashion in the rotational direction of the cylinder, but the needle head pitch in the axial direction of the cylinder is narrowed by using no spacer sheets between adjoining needle plates. The needle head pitches $P_{1-1}$, $P_{1-2}$, $P_{2-1}$ and $P_{2-2}$ in the rotational direction of the cylinder as seen from the axial direction of the cylinder are of regular pitch.

At least in the rearmost row at the rear part B of the combing operation, needle plates ($B_1$, $B_2$, $B_3 \ldots B_n$) are arranged in such a fashion that a needle plate with two needle heads and a needle plate with a single head alternate with each other and the needle heads are arranged in a zig-zag fashion. Besides, the needle head $\beta_1$ of a one-headed needle plate is arranged in front of the rear needle head $\beta_2$ of an adjacent two-headed needle plate, with the pitch therebetween shifted back by $P_{n-2}$ as seen from the axial direction of the cylinder.

The ratio between the needle head pitch $P_{n-1}$ (of the front needle head $\beta_3$ of a two-headed needle plate and the needle head $\beta_1$ of an adjacent one-headed needle plate as seen from the axial direction of the cylinder) and the above-mentioned $P_{n-2}$ should preferably be 1:½–1/20. If this ratio of needle head pitch is 1: more than ½, combing action by needle heads becomes weak. On the contrary, if the ratio is 1: less than 1/20, the combing action becomes too strong and is liable to cut the fiber. It is recommended that at the intermediate part between the above-mentioned front part A and the rear part B of the combing operation, the needle head density is gradually increased from the front part toward the rear part so as to make the ratio of needle head pitch smaller and smaller toward the rear part.

In this embodiment, it is so designed that at the front part where the combing cylinder first acts on the fiber, combing action is carried out slowly so as to avoid cutting of the fiber and at least in the rearmost row, the combing action is carried out more strongly so as to remove short fiber, pods and other impurities, as well as to improve the degree of parallelization. In general, needle strength becomes weak if the number of needle heads on one needle plate is increased. But according to the present invention, the combination of alternate single-head needle plates and two-headed needle plates does not affect the needle strength adversely or rather improves combing action, irrespective of the increase of needle heads on one needle plate.

Since the combing cylinder of a comber according to the present invention is constructed as mentioned above, it can perform the best combing action suitable for the fiber, can prevent cutting of the fiber, can remove short fiber, pods and other impurities and can improve the degree of parallelization.

In addition, the combing cylinder of a comber according to the present invention has such advantages that the concave part of a needle plate is positioned substantially at the central part of the needle plate and can be utilized as a standard hole size in the manufacturing process of the needle plates, the needle plates can be laminated easily, fastening of plural needle plates can be done easily and yet firmly, and a damaged part of the needle plates laminated member can be removed easily. Moreover, since the grooves made in the combing cylinder according to the present invention are inclined in the rotational direction of the cylinder, needle plates mounted in such grooves are prevented from being pulled out while the cylinder is revolving, and moderate interlocking of the grooves and the needle plates can be maintained for many years.

What is claimed is:

1. A combing cylinder assembly for use with a comber, said assembly comprising:

a combing cylinder adapted to be rotated in a combing direction, said cylinder having therein a plurality of axially extending grooves arranged in rows, each said groove having an outer portion opening onto the surface of said cylinder and a bottom portion, said groove extending outwardly from said bottom portion to said outer portion in a direction inclined forwardly toward said combing direction of rotation with respect to a radius of said cylinder;

a plurality of laminated needle plate assemblies, each said needle plate assembly comprising a plurality of needle plates joined together and fitted into a respective said groove;

each said needle plate including a needle insertion part to fit into a said groove and a needle base part to seat on the exterior of said cylinder, said needle base part having extending outwardly therefrom a needle head, said needle insertion part and said needle base part joining at an angle and together forming a substantially acute angle < shape with a concave recess formed in the corner therebetween; and said plurality of needle plates of each said needle plate assembly being joined by insertion in said concave recesses of said plurality of needle plates a single elongated connecting and locking member, thereby forming a said laminated needle plate assembly.

2. An assembly as claimed in claim 1, wherein said angle formed by said needle insertion part and said needle base part comprises an acute angle.

3. An assembly as claimed in claim 1, wherein said needle head is inclined forwardly in said combing direction of rotation with respect to a radius of said cylinder.

4. An assembly as claimed in claim 3, wherein the angle of forward inclination of each said groove is equal to the angle of forward inclination of said needle head ±20°.

5. An assembly as claimed in claim 1, wherein said needle base part of each said needle plate extends in a direction opposite to said combing direction of rotation.

6. An assembly as claimed in claim 1, further comprising, interposed between each axially adjacent pair of said needle plates, a spacer member having an insertion part and a base part joined at said angle and with a concave recess formed in the corner therebetween.

7. An assembly as claimed in claim 6, wherein said concave recess in said spacer member is of larger size than said concave recess formed in each said needle plate.

8. An assembly as claimed in claim 6, wherein said spacer member is formed of a synthetic resin material.

9. An assembly as claimed in claim 1, wherein said connecting and locking member is a bar or tube made of compressible metal.

10. An assembly as claimed in claim 1, wherein said needle heads of said needle plates in a said needle plate assembly are aligned in a zig-zag arrangement extending axially of said cylinder.

* * * * *